US009180722B2

(12) United States Patent
Hosoya et al.

(10) Patent No.: US 9,180,722 B2
(45) Date of Patent: Nov. 10, 2015

(54) MECHANICAL PENCIL HAVING LEAD-ROTATING MECHANISM

(71) Applicant: MICRO CO., LTD., Tokyo (JP)

(72) Inventors: Tomohiro Hosoya, Fukushima-ken (JP); Akihiro Ohkouchi, Fukushima-ken (JP)

(73) Assignee: MICRO CO., LTD. (JP)

( * ) Notice: Subject to any disclaimer, the term of this patent is extended or adjusted under 35 U.S.C. 154(b) by 337 days.

(21) Appl. No.: 13/908,182

(22) Filed: Jun. 3, 2013

(65) Prior Publication Data

US 2014/0079462 A1 Mar. 20, 2014

(30) Foreign Application Priority Data

Sep. 18, 2012 (JP) ..... 2012-203980

(51) Int. Cl.

| | |
|---|---|
| ***B43K 21/027*** | (2006.01) |
| ***B43K 21/02*** | (2006.01) |
| ***B43K 21/22*** | (2006.01) |
| *B43K 21/16* | (2006.01) |

(52) U.S. Cl.

CPC ..... *B43K 21/027* (2013.01); *B43K 21/02* (2013.01); *B43K 21/22* (2013.01); *B43K 21/16* (2013.01)

(58) Field of Classification Search

CPC ..... B43K 21/00; B43K 21/02; B43K 21/027; B43K 21/16; B43K 21/22

USPC ..... 401/65

See application file for complete search history.

(56) References Cited

U.S. PATENT DOCUMENTS

| | | | | |
|---|---|---|---|---|
| 2,520,796 | A * | 8/1950 | Bouhier | 401/56 |
| 3,850,531 | A * | 11/1974 | Ackermann | 401/65 |
| 4,269,524 | A * | 5/1981 | Hashimoto et al. | 401/65 |
| 4,381,158 | A * | 4/1983 | Garganese | 401/111 |
| 4,895,467 | A * | 1/1990 | Kageyama et al. | 401/65 |
| 4,917,518 | A * | 4/1990 | Chern | 401/65 |
| 7,802,936 | B1 * | 9/2010 | Izawa et al. | 401/93 |
| 2009/0180824 | A1 * | 7/2009 | Izawa et al. | 401/66 |
| 2010/0232863 | A1 * | 9/2010 | Izawa et al. | 401/81 |
| 2010/0239351 | A1 * | 9/2010 | Izawa et al. | 401/57 |
| 2010/0266325 | A1 * | 10/2010 | Izawa et al. | 401/93 |
| 2010/0322695 | A1 * | 12/2010 | Ohsawa et al. | 401/65 |
| 2012/0230751 | A1 * | 9/2012 | Noguchi | 401/65 |
| 2013/0058702 | A1 * | 3/2013 | Handrinos | 401/92 |
| 2014/0016982 | A1 * | 1/2014 | Izawa et al. | 401/68 |

(Continued)

FOREIGN PATENT DOCUMENTS

| | | |
|---|---|---|
| JP | 3852172 | 11/2006 |
| JP | 4240417 | 3/2009 |

*Primary Examiner* — David Walczak
*Assistant Examiner* — Bradley Oliver
(74) *Attorney, Agent, or Firm* — Adams & Wilks

(57) ABSTRACT

A mechanical pencil incrementally rotates a lead by operation of a touch button. The pencil has a barrel in which is disposed a holder. A rotatable pipe having a writing mechanism assembly incorporated therein is attached rotatably to the holder. Around the periphery of the holder, a slide member is disposed to undergo forward and rearward movement, and the slide member is moved forward by pressing the touch button disposed on the barrel. The holder houses a sleeve which is moved forward by the slide member and which turns in a circumferential direction. A rotation-transmitting cam face is provided on each of a front end face of the sleeve and a rear end face of the rotatable pipe. By the forward movement of the sleeve, the cam faces are engaged with each other to incrementally rotate the rotatable pipe, whereby the lead is incrementally rotated.

20 Claims, 14 Drawing Sheets

(56) References Cited

U.S. PATENT DOCUMENTS

2015/0023714 A1* 1/2015 Izawa et al. ..... 401/65
2015/0030369 A1* 1/2015 Hosoya ..... 401/65
2015/0050061 A1* 2/2015 Izawa et al. ..... 401/65
2015/0063893 A1* 3/2015 Oomoto et al. ..... 401/62

* cited by examiner

MECHANICAL PENCIL HAVING LEAD-ROTATING MECHANISM

BACKGROUND OF THE INVENTION

1. Field of the Invention

The present invention relates to a lead-rotatable mechanical pencil in which the front end of a lead worn away by writing can be rotated without changing the user's gripped position of the mechanical pencil.

2. Background Information

When the front end of a lead is worn away by writing, the line becomes thicker, and therefore there has been known a mechanical pencil having a lead-rotating mechanism in which a pointed lead condition can be recovered by rotating the lead. As the lead-rotating mechanism, various structures have been known.

For example, in a mechanism utilizing writing pressure described in Japanese Patent No. 4240417, a front end of a slider protrudes from a tip member disposed at the front end of a barrel and retracts at the time of writing, and this retraction movement makes the lead rotate via a gear. However, in this mechanism, the lead rotates freely by the presence or absence of the writing pressure regardless of the wearing condition of the lead. For example, when a figure made of straight lines is continuously drawn, even if the lead is not worn away, the lead rotates when the front end of the lead is raised apart from paper face. In such instance, when the writing front end is raised in writing, the thickness of straight line is changed halfway. When characters are drawn, since the lead rotates per stroke of the character, it is difficult to keep the thickness of the line uniform. As explained above, in such a structure in which the lead is made to rotate on the basis of writing pressure, the front end of the lead may undesirably rotate regardless of the user's intention. In addition, this type mechanism uses a mechanism that rotates the gear with the movement on writing, and the front end of the slider may sometimes slip into the inside of a tip member, and therefore this mechanism is hardly usable.

With respect to a side knocking type-mechanical pencil, a mechanism in which a lead is rotated by pressing a side knocking button has been known. For example, in the mechanism of a mechanical pencil described in Japanese Patent No. 3852172, a slider is moved by pressing a knocking piece, the movement of the slider moves a lead reservoir, the movement of the lead reservoir moves a slide cam, and the movement of the slide cam moves a rotating cam. The rotation of the rotating cam turns the lead reservoir and a chuck member fixed to the lead reservoir.

As mentioned above, conventionally known lead rotating-type mechanical pencils have complicated structures, a large number of parts, and such pencils cannot be produced and assembled at low cost.

SUMMARY OF THE INVENTION

An object of the present invention is to provide a mechanical pencil having a lead-rotating mechanism that overcomes the aforementioned drawbacks of the prior art.

Another object of the present invention is to provide a mechanical pencil having a lead-rotating mechanism that can be operated by the user at will to incrementally rotate the lead while gripping the pencil for writing without the user changing the gripped position.

It is another object of the present invention to provide a mechanical pencil in which the front end of a lead that becomes worn away by writing can be rotated at will by the user without the user changing the gripped position of the pencil and in which the front end of the pencil does not accidently slip into the inside of a tip member.

The foregoing and other objects of the present invention are realized by a mechanical pencil having a barrel and a rotatable pipe rotatably disposed in the barrel and having therein a writing mechanism assembly having a lead reservoir, a chuck, a chuck ring and a chuck spring. A holder rotatably holds the rotatable pipe in the barrel, and a slide member is movably disposed in the barrel for axial back-and-forth movement and urged backward. A touch button is disposed on the barrel and, when passed inward, axially advances the slide member, and a sleeve is slidably disposed in the holder and made to advance toward a rear end of the rotatable pipe by the slide member when the slide member axially advances. A rotating cam mechanism is disposed between the sleeve and the holder to rotate the sleeve when the sleeve moves, and rotation-transmitting cam faces are provided at a forward end face of the sleeve and a rear end face of the rotatable pipe and engage with each other as the sleeve axially advances.

The mechanical pencil of the present invention may further comprise a return-preventing mechanism to limit the rotation direction of the rotatable pipe between the rotatable pipe and the holder, and a return spring between the rotatable pipe and the sleeve to urge the sleeve backward. The mechanical pencil may further comprise a forward end slide ring which slidably contacts with the rear end of the rotatable pipe at the front face of the return spring, and a rear end slide ring fixed to the sleeve at the rear face of the return spring.

Since the mechanical pencil of the present invention has the above-mentioned structure, retraction movement of the rotatable pipe is prevented at the time of writing so that the pencil can be used like conventional mechanical pencils in a writing mode. When the front end of the lead becomes worn away and its thickness becomes large due to writing, the user pushes the touch button to operate the pencil in a lead-rotating mode. By the operation of the touch button, the slide member advances and presses on the sleeve causing the sleeve to advance. The rotation-transmitting cam face at the forward end face of the advanced sleeve engages with the rotation-transmitting cam face at the rear end face of the rotatable pipe as the sleeve advances, and at the same time, the sleeve is made to rotate by the rotating cam mechanism disposed between the sleeve and the holder.

As a result, the rotatable pipe incrementally rotates, whereby the writing mechanism assembly incorporated in the rotatable pipe also incrementally rotates thereby incrementally rotating the lead. When the press of the touch button is stopped, the slide member axially retracts by the action of the return spring and the rotation of the lead stops. As explained above, the lead can be rotated at will by the user. In addition, since no member moves in response to the writing pressure, there is no fear that the front end accidently slips into the inside of a tip member as may happen in the prior art.

Further, by disposing the return-preventing mechanism between the rotatable pipe and the holder, the rotation direction of the lead can be limited and it becomes possible to always incrementally rotate the lead in the same direction so that the front end of the lead forms an acute angle. If a front end slide ring and a rear end slide ring are disposed at the front and rear ends of the return spring, respectively, the return spring does not become an obstacle when the rotatable pipe rotates, and smooth rotation can be secured.

Additional objects, advantages and features of the present invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

FIGS. 1A-1D are cross-sectional views showing an example of a mechanical pencil according to the present invention, wherein FIG. 1A is a longitudinal cross-sectional view thereof, FIG. 1B is a cross-sectional view taken along line 1B-1B in FIG. 1A, FIG. 1C is a cross-sectional view taken along line 1C-1C in FIG. 1A, and FIG. 1D is a cross-sectional view taken along line 1D-1D in FIG. 1A.

FIGS. 2A-2D show a front barrel, wherein FIG. 2A is a longitudinal cross-sectional view thereof, FIG. 2B is a front view thereof, FIG. 2C is a cross-sectional view thereof rotated 90° from the position shown in FIG. 2A, and FIG. 2D is a cross-sectional view taken along line 2D-2D in FIG. 2C.

FIGS. 3A-3D show a rear barrel, wherein FIG. 3A is a plan view thereof, FIG. 3B is a front view thereof, FIG. 3C is a longitudinal cross-sectional view thereof, and FIG. 3D is a left side view thereof.

FIGS. 4A-4F show a rotatable pipe, wherein FIG. 4A is a plan view thereof, FIG. 4B is a front view thereof, FIG. 4C is a longitudinal cross-sectional view thereof, FIG. 4D is a right side view thereof, FIG. 4E is a cross-sectional view taken along line 4E-4E in FIG. 4C, and FIG. 4F is a cross-sectional view taken along line 4F-4F in FIG. 4C.

FIGS. 5A-5I show a holder, wherein FIG. 5A is a plan view thereof, FIG. 5B is a front view thereof, FIG. 5C is a left side view thereof, FIG. 5D is a right side view thereof, FIG. 5E is a longitudinal cross-sectional view thereof, FIG. 5F is a cross-sectional view taken along line 5F-5F in FIG. 5E, FIG. 5G is a cross-sectional view taken along line 5G-5G in FIG. 5E, FIG. 5H is a cross-sectional view taken along line 5H-5H in FIG. 5E, and FIG. 5I is a cross-sectional view taken along line 5I-5I in FIG. 5E.

FIGS. 6A-6K show a slide member, wherein FIG. 6A is a plan view thereof, FIG. 6B is a front view thereof, FIG. 6C is a left side view thereof, FIG. 6D is a right side view thereof, FIG. 6E is a longitudinal cross-sectional view thereof, FIG. 6F is a cross-sectional view taken along line 6F-6F in FIG. 6E, FIG. 6G is a cross-sectional view taken along line 6G-6G in FIG. 6E, FIG. 6H is a cross-sectional view taken along line 6H-6H in FIG. 6E, FIG. 6I is a cross-sectional view taken along line 6I-6I in FIG. 6E, FIG. 6J is a cross-sectional view taken along line 6J-6J in FIG. 6E, and FIG. 6K is a cross-sectional view taken along line 6K-6K in FIG. 6E.

FIGS. 7A-7E show a sleeve, wherein FIG. 7A is a plan view thereof, FIG. 7B is a front view thereof, FIG. 7C is a longitudinal cross-sectional view thereof, FIG. 7D is a left side view thereof, and FIG. 7E is a cross-sectional view taken along the line 7E-7E in FIG. 7C.

FIGS. 8A-8B shown a forward end slide ring, wherein FIG. 8A is a right side view thereof and FIG. 8B is a cross-sectional view thereof.

FIGS. 9A-9C show a rear end slide ring, wherein FIG. 9A is a front view thereof, FIG. 9B is a cross-sectional view thereof and FIG. 9C is a left side view thereof.

FIGS. 13A-13D shows the relation between opposed rotation-transmitting cam faces of a rotating cam mechanism when a touch button is operated, wherein FIG. 13A shows an initial, regular position where the touch button is not pressed and the cam faces are disengaged, FIG. 13B shows a position where the sleeve starts to advance by pressing the touch button and the cam faces begin to engage, FIG. 13C shows a position where the sleeve has rotated through its full angular increment and the cam faces are fully engaged, and FIG. 13D shows a position where the sleeve starts to retract by stopping the operation of the touch button and the cam faces begin to disengage.

DETAILED DESCRIPTION OF THE PREFERRED EMBODIMENTS

Figure 1A:
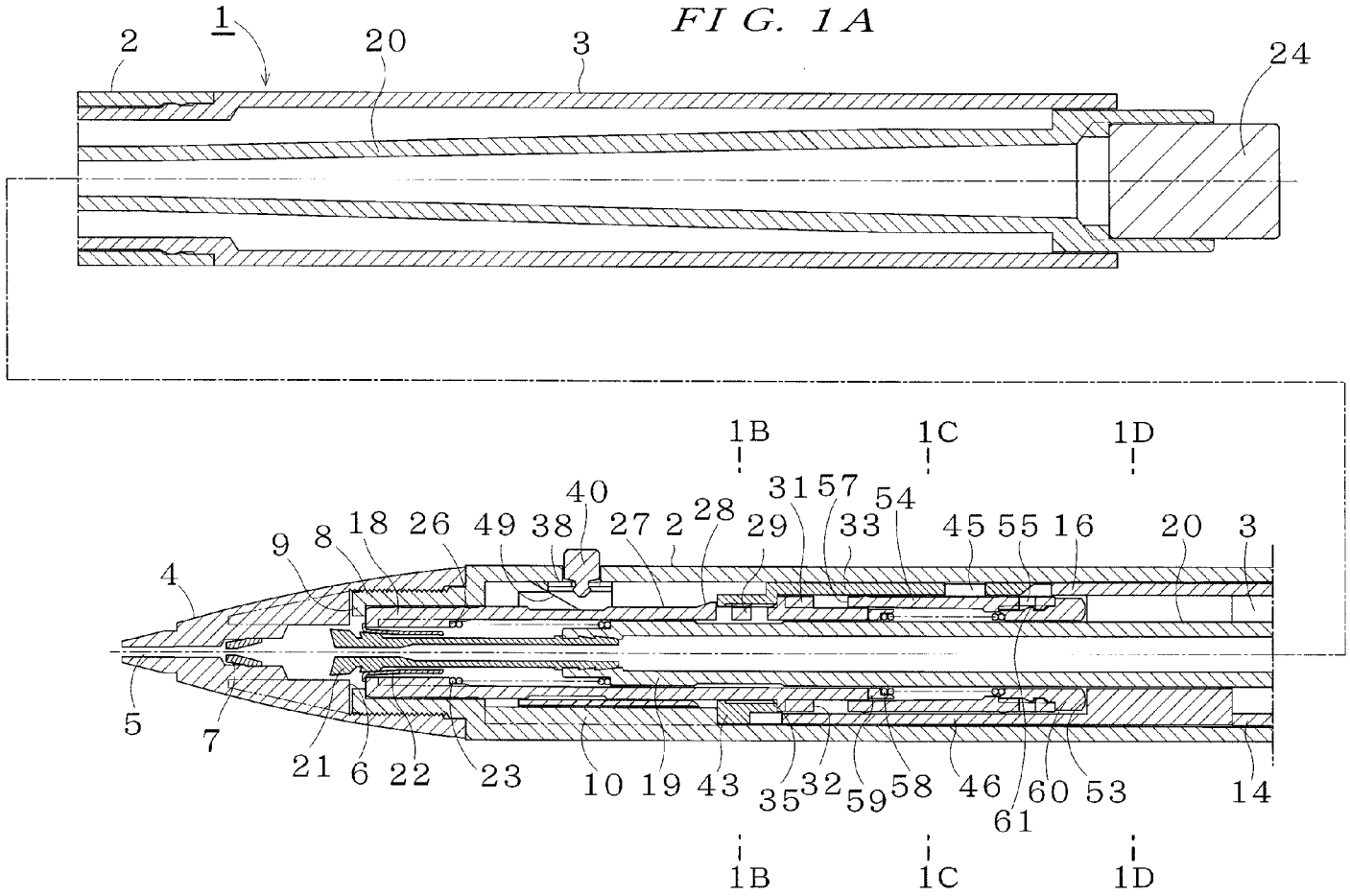
Figure 1B:
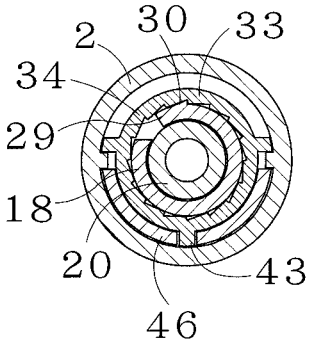
Figure 1C:
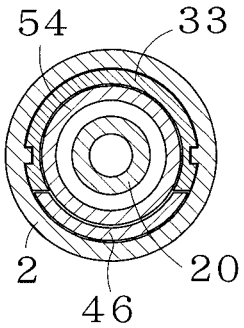
Figure 1D:
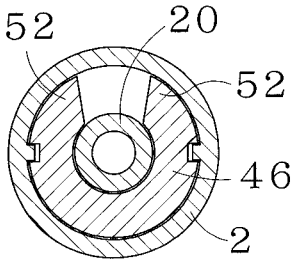
Figure 2A:
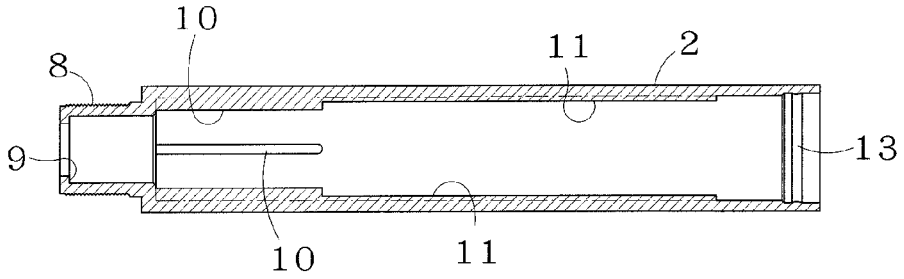
Figure 2B:
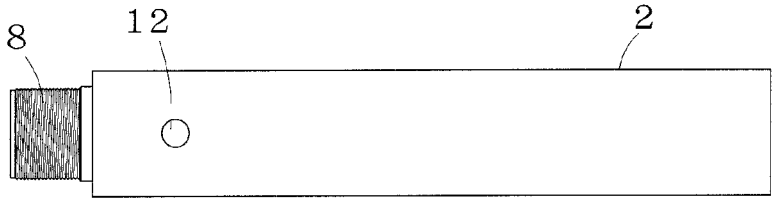
Figure 2C:
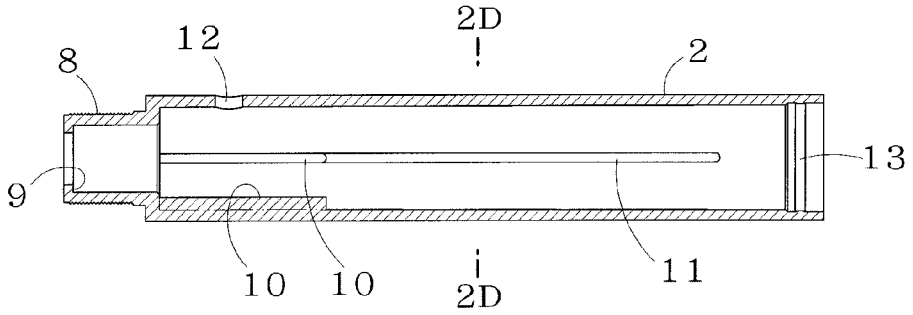
Figure 2D:
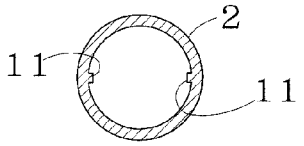
Figure 3A:
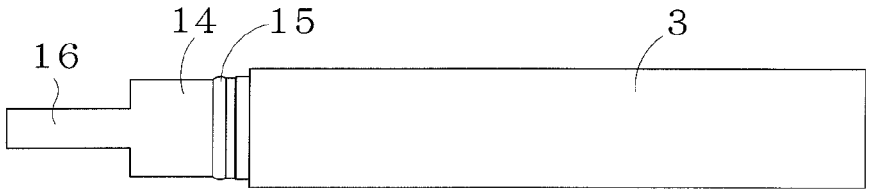
Figure 3B:
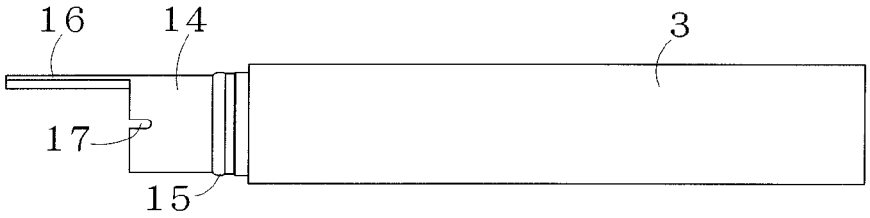
Figure 3C:
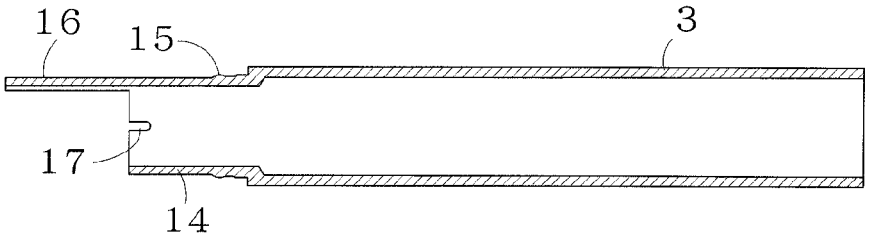
Figure 3D:
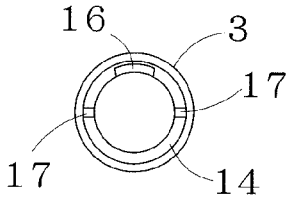
Figure 4A:
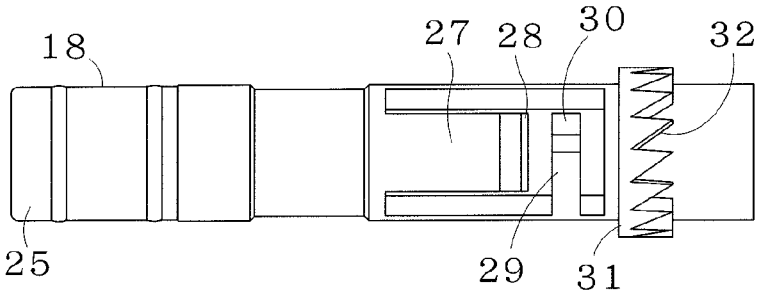
Figure 4B:
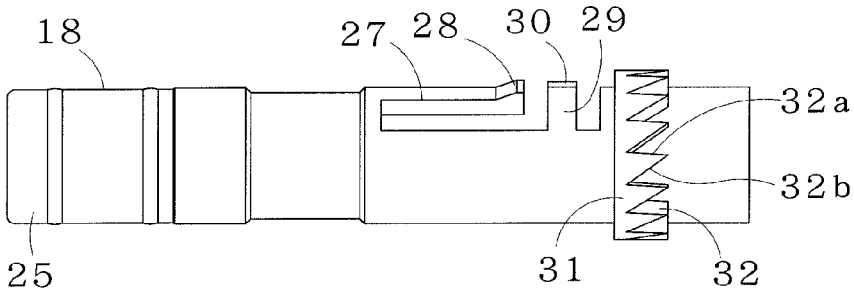
Figure 4C:
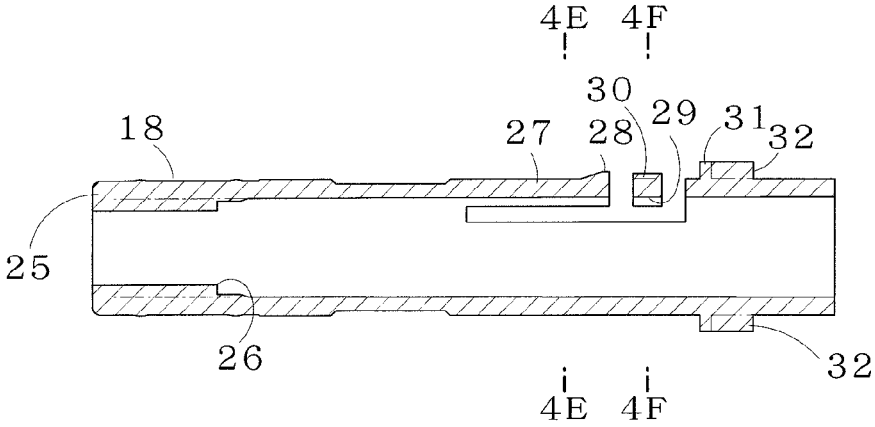
Figure 4D:
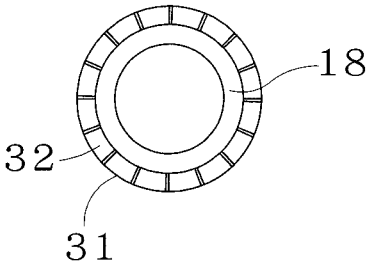
Figure 4E:
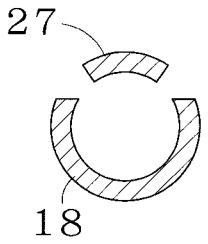
Figure 4F:
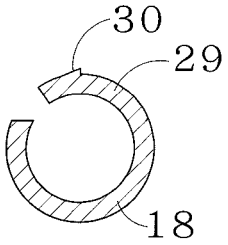

As illustrated in FIGS. 1A-1D, a mechanical pencil according to one example of the present invention comprises a barrel 1 having a tubular front barrel 2 and a tubular rear barrel 3 connected to the front barrel 2, and a tip member 4 threadedly connected to the front barrel 2. In the tip member 4, a lead through-hole 5 is formed and from which a lead (not shown) protrudes during use of the mechanical pencil. The interior of the tip member 4 has a stepped portion 6 and a lead-retaining member 7 which frictionally retains the lead.

As illustrated in FIGS. 2A-2D, the front barrel 2 has a small diameter section 8 at its front end for threaded connection with the tip member 4, and a flange 9 is formed at the front portion of the small diameter section 8. Along the interior of the front barrel 2, stopper ribs 10 and guide ribs 11 extending in an axial direction are formed. A hole 12 which opens outwardly is formed at an intermediate portion of the front barrel 2 and at the inner face of the rear end opening of the front barrel, an engaging portion 13 is formed.

As shown in FIGS. 3A-3D, a fitting section 14 which is inserted into the rear end opening of the front barrel 2 is formed at the front portion of the rear barrel 3. An engaging portion 15 which engages with the engaging portion 13 of the front barrel is formed around the outer periphery of the fitting section 14. At the front portion of the fitting section 14, a projection 16 extending forward and insertion grooves 17 which can be connected to the rear end of the guide ribs 11 are formed, by which positioning of the projection 16 can be made when the rear barrel 3 is connected to the front barrel 2.

A rotatable pipe (tubular member) 18 is rotatably housed inside the barrel 1. The front end of the rotatable pipe 18 is inserted into the small diameter section 8 of the front barrel 2, and the front end thereof abuts on the flange 9. Inside the rotatable pipe 18, a writing mechanism assembly 19 is incorporated. As shown in FIG. 1A, the writing mechanism assembly 19 has a lead reservoir 20 for storing a lead, a chuck 21 which is connected to the front end of the lead reservoir 20 and releasably grips the lead, a chuck ring 22 fitted on the outer periphery of the chuck 21 to control the opening and closing of the chuck 21, and a chuck spring 23 for urging the lead reservoir 20 backward. An eraser 24 is attached to the rear section of the lead reservoir 20.

As shown in FIGS. 1A and 4A-4F, the chuck 21 and the chuck ring 22 are inserted in a front section 25 of the rotatable pipe 18. At the inner face of the front section of the rotatable pipe 18, a stepped portion 26 for supporting one end of the chuck spring 23 is provided. The rear end of the chuck spring 23 abuts on the lead reservoir 20. An intermediate elastic piece 27 which extends in an axial direction and is elastically movable in a radial direction is formed at the intermediate portion of the rotatable pipe. At the front end of the intermediate elastic piece 27, a detachment-preventing pawl 28 protruding outwardly is provided. At the rear side of the intermediate elastic piece 27, an outer peripheral elastic piece 29 which extends in a circumferential direction and is elastically movable in a radial direction is formed. A return-preventing pawl 30 is provided at the front end of the outer peripheral elastic piece 29. Just behind the rear end portion of the rotatable pipe 18, a large diameter portion 31 having a larger diameter than the front portion of the rotatable pipe is formed, and at the rear face of the large diameter portion 31 is provided a rotation-transmitting cam face 32 formed in a substantially saw-edged shape constituted by axial faces 32*a* extending in an axial direction and slant faces 32*b* slanting in a circumferential direction.

Figure 5A:
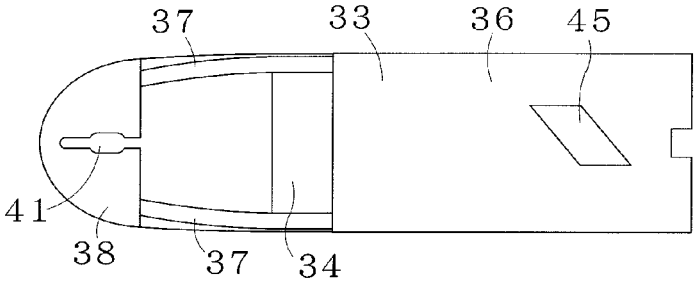
Figure 5B:
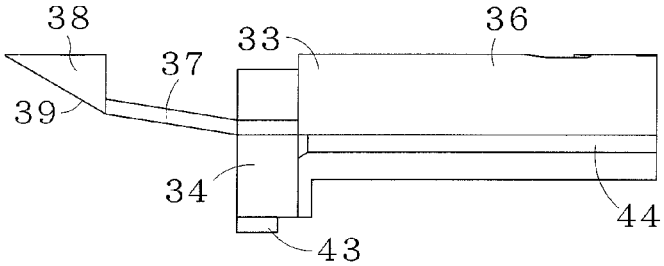
Figure 5C:
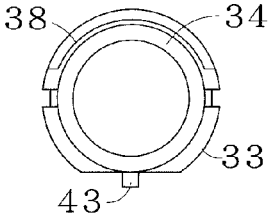
Figure 5D:
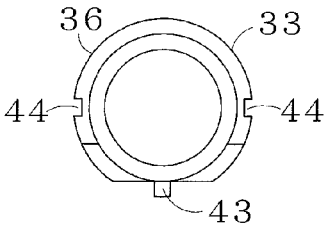

In the barrel 1, a holder 33 is provided for holding the rotatable pipe 18 rotatably while preventing its axial back-and-forth movement. As shown in FIGS. 5A-5I, the holder 33 has a tubular portion 34 and a guide piece 36 which extends backward via a shoulder 35 and is formed in a substantially semi-circular shape with its one side face opened. At both sides of the outer face of the tubular portion 34, supporting pieces 37 which extend forward and are capable of elastically flexing upward and downward are disposed so that they protrude from the tubular portion in spaced-apart relation to each other (FIG. 5A). At the side face of a front end portion 38 connected to the forward end of the supporting pieces 37, a slanting face 39 is formed for conducting a pressing operation (described below), and at the outer face of the front end portion 38, a hole 41 is provided for installing a touch button (pushbutton) 40. The touch button 40 protrudes outwardly in a retractable fashion through the hole 12 of the barrel 2 as shown in FIG. 1A.

Figure 5E:
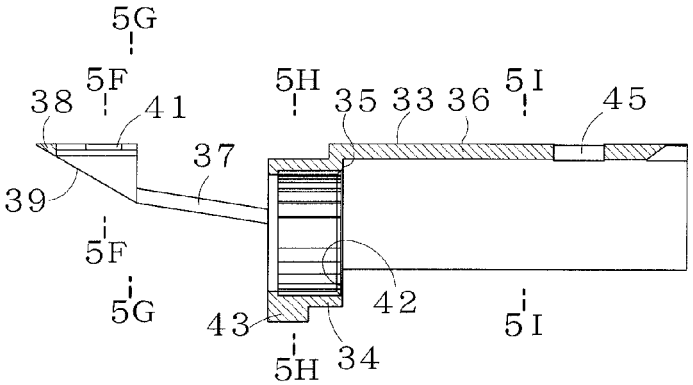
Figure 5F:
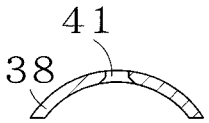
Figure 5G:
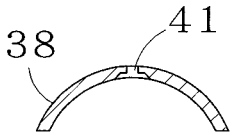
Figure 5H:
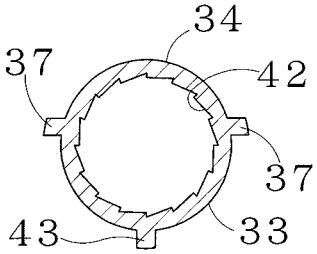
Figure 5I:
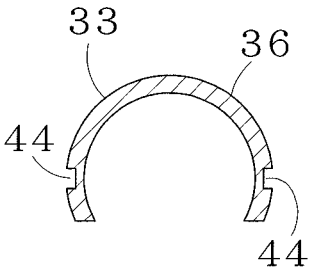
Figure 6A:
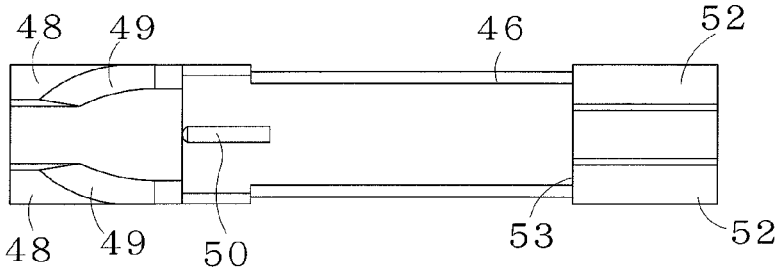
Figure 6B:
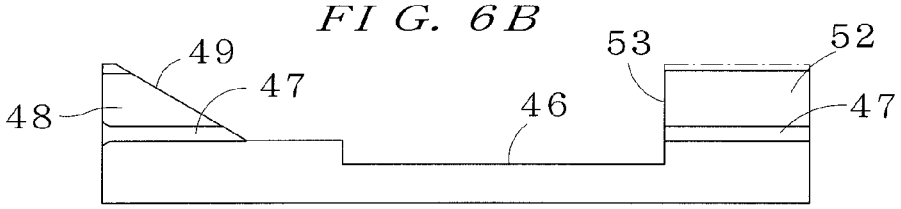
Figure 6C:
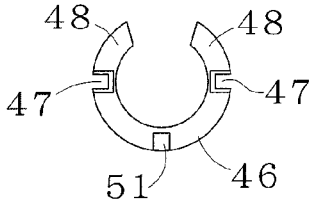
Figure 6D:
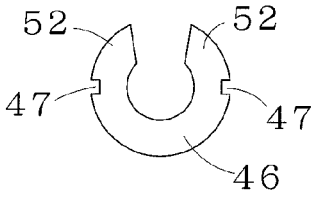
Figure 6E:
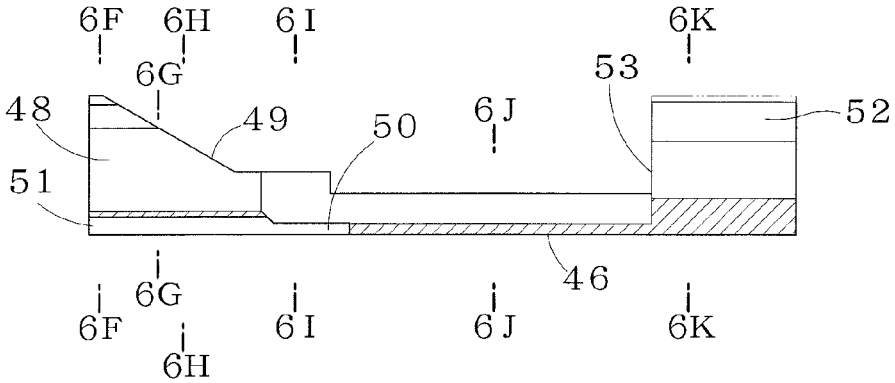
Figure 6F:
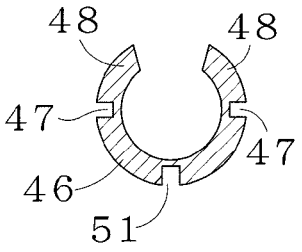
Figure 6G:
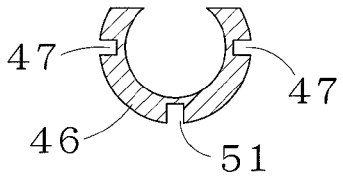
Figure 6H:
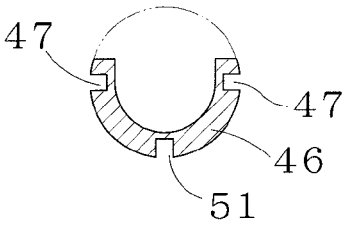
Figure 6I:
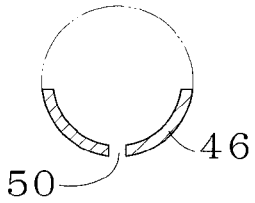
Figure 6J:
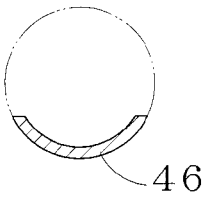
Figure 6K:
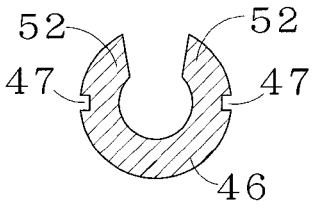
Figure 7A:
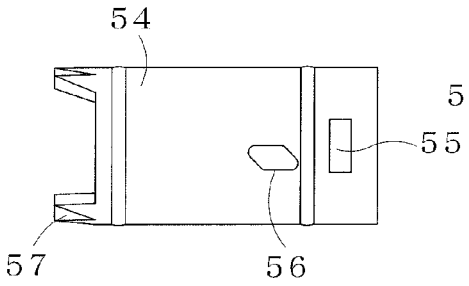
Figure 7B:
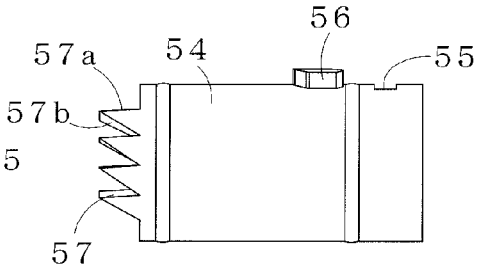
Figure 7C:
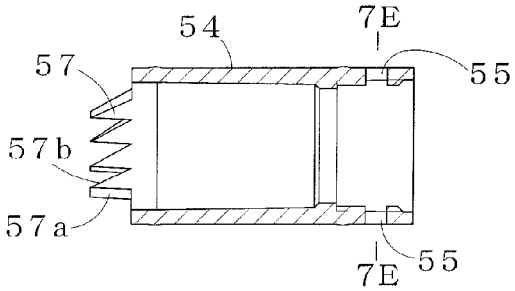
Figure 7D:
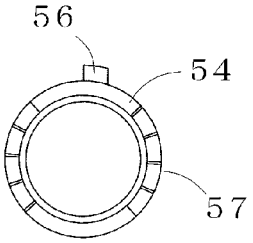
Figure 7E:
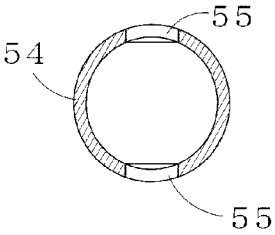

At the inner face of the tubular portion 34, there is provided a gear face 42 for return-prevention and which is constituted by a substantially saw-edged uneven face having slanting faces which slant in a rotational direction and rising faces which rise in a radial direction from the base of the slanting face (FIGS. 5E and 5H). The return-preventing pawl 30 of the rotatable pipe 18 engages with the gear face 42. By this structure, a return-preventing mechanism is constituted in which, when the rotatable pipe 18 turns in one direction (counterclockwise in FIG. 12), the pawl 30 rides over the slanting face of the gear face to allow rotation of the rotatable pipe, and when the rotatable pipe 18 attempts to turn in the opposite direction (clockwise direction in FIG. 12), the pawl 30 engages with the rising face to prevent rotation of the rotatable pipe.

A locking projection 43 protrudes from the outer face of the tubular portion 34. On the guide piece 36, guide grooves 44 are form for insertion into the guide ribs 11 of the front barrel 2. On the peripheral face of the guide piece 36, a substantially parallelogram-shaped guide window 45 which extends in a circumferential direction and slants back and forth is formed (FIG. 5A). The holder 33 is fixed in the barrel 1 by making the locking projection 43 formed at its front end abut on the rear end of the stopper ribs 10 of the front barrel 2 and holding the rear end of the guide piece 36 by the projection 16 of the rear barrel 3. If desired, the holder 33 and the barrel 1 may be integrally formed. The rotatable pipe 18 is inserted into the tubular portion 34 from the rear portion of the holder 33, the front end of the tubular portion 34 of the holder is made to abut on the detachment-preventing pawl 28 of the rotatable pipe 18, and the large diameter portion 31 of the rotatable pipe 18 is made to abut on the shoulder 35 of the tubular portion 34, whereby the rotatable pipe 18 is rotatably held by the holder 33.

In the barrel 1, a slide member 46 is movably disposed to undergo back-and-forth axial movement. As shown in FIGS. 6A-6K, the slide member 46 is formed in a substantially semi-circular shape with one side opened so that it may receive the holder 33, and on the outer periphery of the slide member 46, guide grooves 47 which are to be slidably fitted in the guide ribs 11 of the front barrel 2 are formed. At the front portion of the slide member 46, two opposed front walls 48 are provided, the front walls being spaced apart from each other a suitable distance so that the rotatable pipe 18 can be inserted from the lateral side. At each of the front walls 48, there is formed a slanting face 49 which slidably contacts with the slanting face 39 formed at the front end portion of the holder 33. At the intermediate portion of the slide member 46, a long hole 50 through which the locking projection 43 of the holder 33 is to be inserted and a guide groove 51 which is to be fitted in one of the stopper ribs 10 of the front barrel 2 are formed. The long hole 50 has such a length that the slide member 46 can be moved adequately in an axial direction. At the rear portion of the slide member 46 two opposed rear walls 52 are provided, the rear walls being spaced apart from each other a suitable distance so that the lead reservoir 20 and the projection 16 of the rear barrel 3 can be inserted thereinto. At the front face of each of the rear walls 52, an abutting face 53 is formed.

A sleeve 54 is movably incorporated inside the guide piece 36 of the holder 33 so that the sleeve can undergo limited turning and axial movement. When the slide member 46 axially advances, the sleeve 54 is pressed by the abutting face 53 of the slide member 46 via a rear end slide ring 60 (described later) and made to axially advance toward the rear end of the rotatable pipe 18. As shown in FIGS. 7A-7E, the sleeve 54 is formed in a tubular shape so that it can be axially slidably inserted onto, and axially slidable back and forth along and turnable about, the rear end portion of the rotatable pipe 18. As illustrated the sleeve 54 has a pair of diametrically opposed holes 55 at its rear portion. At the outer face of the sleeve 54, a substantially parallelogram-shaped control projection 56 which enters the guide window 45 of the holder 33 is formed. Further, at the front end face of the sleeve 54, a rotation-transmitting cam face 57 is disposed. The rotation-transmitting cam face 57 has a substantially saw-edged shape constituted by axial faces 57*a* extending in an axial direction and slant faces 57*b* slanting in a circumferential direction, and the sleeve 54 can incrementally rotate (turn) the rotatable pipe 18 when the cam face 57 engages with the rotation-transmitting cam face 32 of the rotatable pipe 18.

Figure 8A:
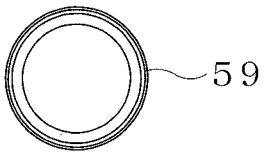
Figure 8B:
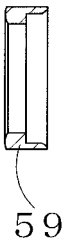
Figure 9A:
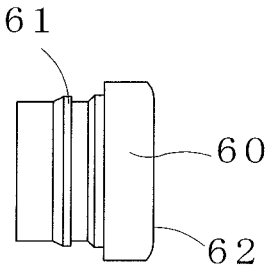
Figure 9B:
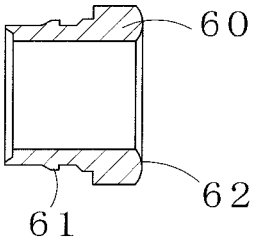
Figure 9C:
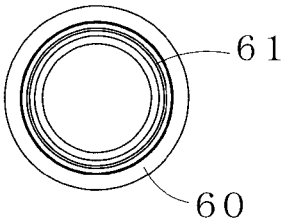

Between the rotatable pipe 18 and the sleeve 54, a return spring 58 is disposed to urge the sleeve 54 axially backward, and the slide member 46 is also urged axially backward by the return spring 58 up to the position where the slide member 46 abuts on the front end of the fitting section 14 of the rear barrel 3. The front face of the return spring 58 is housed in a receiver of a front end slide ring 59 (FIGS. 8A-8B) which slidably contacts with the rear end of the rotatable pipe 18 (FIG. 1A). The rear face of the return spring 58 is housed in a receiver of a rear end slide ring 60 (FIGS. 9A-9C). The rear end slide ring 60 has a locking pawl 61 at its outer peripheral face which locks with hole edges of the holes 55 formed on the sleeve 54 so that the spring 60 can be inserted into and fixed to the rear end of the sleeve 54. At the rear face of the rear end slide ring 60, an abutting face 62 which abuts on the abutting face 53 of the slide member 46 is formed.

Figure 10:
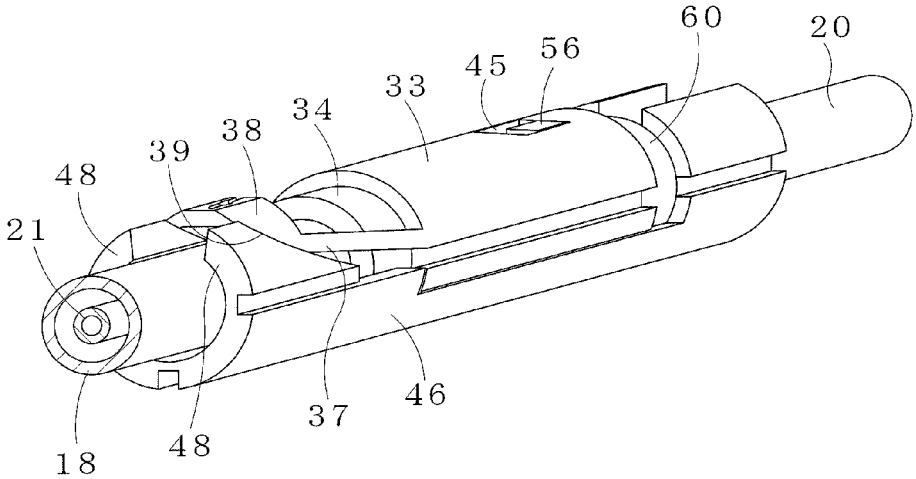
FIG. 10 is an explanatory view showing a state where the rotating pipe is incorporated in the holder.
Figure 11:
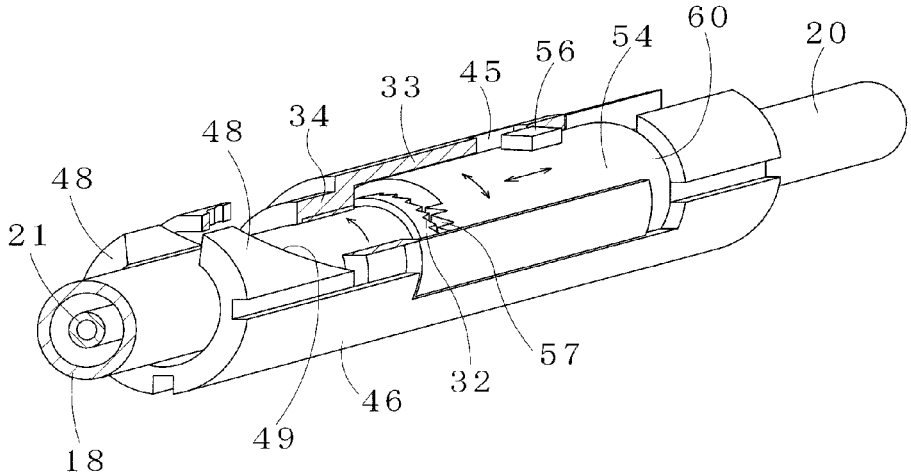
FIG. 11 is an explanatory view showing a state where the rotatable pipe is incorporated in the holder with the holder partially cutaway.
Figure 12:
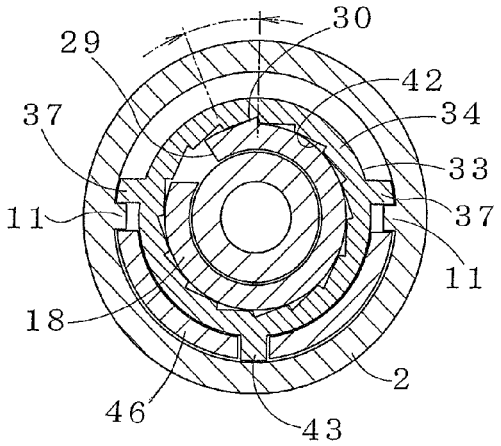
FIG. 12 is a cross-sectional view showing a return-preventing mechanism section.

At the time of assembly of the mechanical pencil, the rotatable pipe 18 having the writing mechanism assembly 19, and the sleeve 54 having incorporated therein the front end slide ring 59, return spring 58 and rear end slide ring 60, are inserted into the holder 33 from the rear side thereof, and then the control projection 56 of the sleeve 54 is inserted into the guide window 45 of the holder. The slide member 46 is then incorporated in the holder 33 and inserted into the front barrel 2, and then the rear barrel 3 is connected to the front barrel 2. By such a construction, a rotating cam mechanism is formed as shown in FIG. 10 and FIG. 11, in which the slide member 46 is fitted around the holder 33, the rotatable pipe 18 is rotatably incorporated in the holder 33, and the sleeve 54 is axially movably and turnably disposed in the holder 33 with the control projection 56 of the sleeve 54 inserted into the guide window 45 of the holder 33. The rotating cam mechanism is assembled in a state in which the rotation-transmitting cam face 32 of the rotatable pipe 18 and the rotation-transmitting cam face 57 of the sleeve 54 are opposed to each other in axially spaced-apart (non-engaging) relation. As shown in FIG. 12, which is an enlarged view of FIG. 1B, the return-preventing pawl 30 of the rotatable pipe 18 engages with the return-preventing gear face 42 of the holder 33 to constitute the return-preventing mechanism. The touch button 40 is inserted from the outside through the hole 12 of the barrel 1, and its forward end is inserted into the hole 41 at the front end portion 38 of the elastically flexible supporting pieces 37 of the holder 33 so that the touch button 40 is locked with the holder 33.

Operation of the mechanical pencil of the present invention will be explained below. When writing, the mechanical pencil illustrated in FIG. 1 is used as a usual knocking-type mechanical pencil, and no description is needed of operating the mechanical pencil in the writing mode, which is well known in the art. Operation of the mechanical pencil in the lead-rotating mode will be described with reference to FIGS. 13A-13D. In FIGS. 13A-13D, the left side illustrates the relationship of the control projection 56 of the sleeve 54 and the guide window 45 of the holder 33 and the right side illustrates the corresponding relationship of the rotation-transmitting cam faces 32 and 57 of the rotatable pipe 18 and sleeve 54, respectively, which constitute the rotating cam mechanism, and the vertical scale of angles shows the angular displacement of the control projection 56 and the cam faces 32 and 57.

Figure 13C:
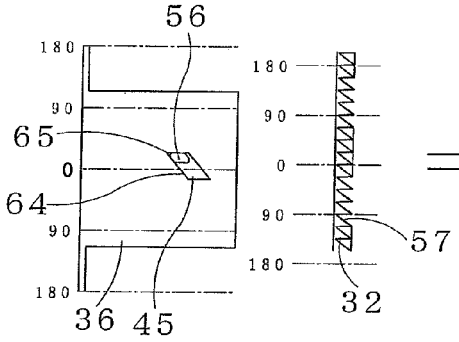
Figure 13D:
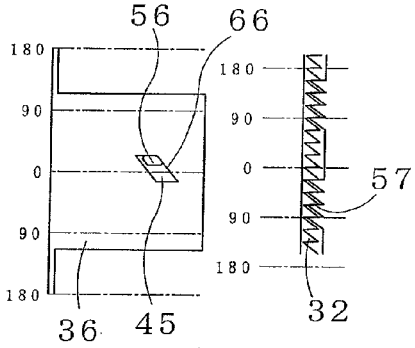
Figure 13B:
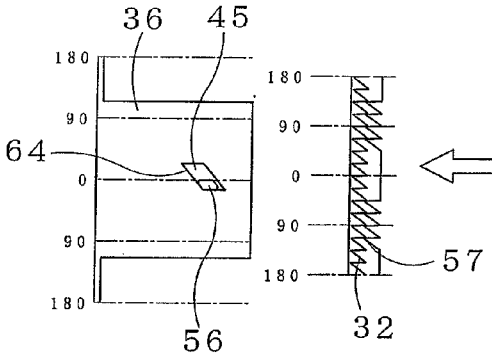
Figure 13A:
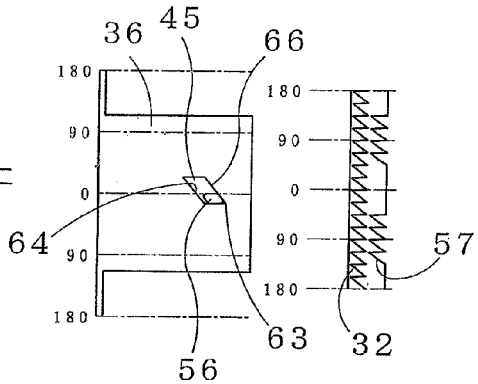

In the state where the touch button 40 is not operated (i.e., not pressed inward), as shown in FIG. 13A, the rotation-transmitting cam faces 32 and 57 are axially spaced and do not engage with each other, and the control projection 56 is located at a rear end 63 of the guide window 45 in its initial, regular position with the leading edge of the control projection 56 on an imaginary 0° reference axis. In this state, when the touch button 40 is pressed, the elastic supporting pieces 37 flex downward and the slanting face 39 of the front end portion 38 of the supporting pieces 37 presses on the slanting face 49 of the slide member 46, whereby the slide member 46 is axially advanced and, at the same time, the sleeve 54 abutting on the slide member 46 also axially advances.

As the sleeve 54 axially advances, as shown in FIG. 13B, the control projection 56 on the sleeve moves axially along the guide window 45 toward the advanced position while the leading edge of the control projection remains on the 0° axis and the rotation-transmitting cam faces 32 and 57 begin to engage with each other. Since the control projection 56 is constrained to move along a front edge 64 of the guide window 45 during continued advancing movement of the sleeve 54, the control projection 56 is guided by the slant of the front edge 64 and turns with the sleeve 54 in a direction toward a front end 65 of the guide window 45 to its maximum rotation position (approximately 22.5° in this example) where the leading edge of the control projection 56 has turned (incrementally rotated) approximately 22.5° as shown in FIG. 13C. By this movement, the rotatable pipe 18 turns without moving axially via the sleeve 54 while the cam faces 32 and 57 engage with each other, and as a result, the lead turns incrementally, i.e., turns through a predetermined angular increment of approximately 22.5° in this example.

When pressing of the touch button 40 is stopped, the elastic supporting pieces 37 flex upward to release the pressing contact between the slanting faces 39 and 49 and the sleeve 54 axially retracts by the return spring 58, and thus the cam face 57 of the sleeve 54 starts to retract and disengage from the cam face 32 of the rotatable pipe 18 as shown in FIG. 13D. Concurrently, the control projection 56 of the sleeve 54 retracts along the guide window 45, and the control projection is guided by a rear edge 66 of the guide window 45 to return to its initial, regular position (FIG. 13A).

The rotation of the rotatable pipe 18 is limited to one direction by the return-preventing mechanism as shown in FIG. 12, and thus the lead does not rotate back toward its original position when the touch button 40 is no longer pressed. As shown by the chain-dotted line in FIG. 12, the mechanism is constituted such that when the touch button 40 is no longer pressed and returns to the position where it protrudes from the barrel, the rotatable pipe 18 stops at the position where it incrementally rotates a distance corresponding to one ridge of the gear face 42, during which the sleeve 54 and control projection 56 return to the regular position shown in FIG. 13A.

In this manner, pressing the touch button 40 causes axial advancement and turning of the sleeve 54 in one direction and the turning of the sleeve 54 turns the pipe 18 via engagement of the cam faces 32 and 57 thereby incrementally rotating the lead. When pressing of the touch button 40 is released, the sleeve 54 axially retracts and turns in the opposite direction to its initial position without turning the pipe 18 which remains in the turned position. Each press-and-release operation of the touch button 40 incrementally rotates or turn the lead a predetermined angular increment.

In the above example, the rotating cam mechanism is constituted by a substantially parallelogram-shaped guide window and a control projection. However, the invention is not limited to this construction and the rotating cam mechanism may be constituted by a slanting window and a pin. Also, the angular increment through which the lead turns in one press-and-release operation of the touch button is not limited to approximately 22.5° and may be any desired, suitable angle. Further, the guide window may be disposed in the sleeve and the control projection may be disposed on the holder. The slide member in the described example is constituted so that it axially advances via a slanting face by pressing the touch button in a radial direction. However, the invention is not limited to this arrangement and the slide member may be made directly axially movable back and forth in the axial direction.

It will be appreciated by those skilled in the art that obvious changes can be made to the examples described in the foregoing description without departing from the broad inventive concept thereof. It is understood, therefore, that this disclosure is not limited to the particular examples disclosed, but is intended to cover all obvious modifications thereof which are within the scope and the spirit of the disclosure as defined by the appended claims.

What is claimed is:

1. A mechanical pencil comprising: a barrel having front and rear ends; a tip member connected to the front end of the barrel and from which a lead projects during use of the pencil; a writing mechanism assembly for supplying a lead to the tip member and gripping the lead during writing; a pipe disposed in the barrel and through which extends the writing mechanism assembly; a holder disposed in the barrel and rotatably holding the pipe; a slide member slidably disposed in the barrel to undergo advancing movement in a frontward direction and retracting movement in a rearward direction; means for urging the slide member rearward; a button accessible from outside the barrel and operative when pressed inward by a user of the pencil to advance the slide member; a sleeve movably disposed in the holder to undergo advancing and retracting movement and limited turning movement in opposite directions, the sleeve being positioned so that advancing movement of the slide member advances the sleeve toward a rear end of the pipe; and a cam mechanism disposed between the holder and the sleeve to turn the sleeve in one direction as the sleeve advances thereby turning the pipe and the writing mechanism assembly, the cam mechanism comprising two rotation-transmitting cam faces, one disposed at a forward end face of the sleeve and the other disposed at a rear end face of the pipe, engageable with each other during advance of the sleeve.

2. A mechanical pencil according to claim 1; wherein the cam mechanism includes a substantially parallelogram-shape guide window and a control projection movable along the edges of the guide window.

3. A mechanical pencil according to claim 2; wherein the guide window is formed in the holder and the control projection is provided on the sleeve and controls the movement of the sleeve.

4. A mechanical pencil according to claim further comprising a return-preventing mechanism that prevents turning of the pipe in the opposite direction when the sleeve turns in the opposite direction.

5. A mechanical pencil according to claim 4; wherein the return-preventing mechanism comprises a return-preventing gear face provided on the holder, and a return-preventing pawl provided on the pipe and slidably engageable with the return-preventing gear face to permit turning of the pipe in the one direction and prevent turning movement of the pipe in the opposite direction.

6. A mechanical pencil according to claim 5; further including a return spring that urges the sleeve rearward.

7. A mechanical pencil according to claim 6; wherein the return spring is disposed between the pipe and the sleeve and urges the sleeve rearward with respect to the pipe.

8. A mechanical pencil according to claim 7; further comprising a forward end slide ring in slidable contact with the rear end of the pipe and engaging the front face of the return spring, and a rear end slide ring fixed to the sleeve and engaging with the rear face of the return spring.

9. A mechanical pencil according to claim 1; further comprising a return-preventing mechanism that prevents turning of the pipe in the opposite direction when the sleeve turns in the opposite direction.

10. A mechanical pencil according to claim 9; wherein the return-preventing mechanism comprises a return-preventing gear face provided on the holder, and a return-preventing pawl provided on the pipe and slidably engageable with the return-preventing gear face to permit turning of the pipe in the one direction and prevent turning movement of the pipe in the opposite direction.

11. A mechanical pencil according to claim 1; further including a return spring that urges the sleeve rearward.

12. A mechanical pencil according to claim 11; further comprising a forward end slide ring in slidable contact with the rear end of the pipe and engaging the front face of the return spring, and a rear end slide ring fixed to the sleeve and engaging with the rear face of the return spring.

13. A mechanical pencil according to claim 1; wherein the holder has an elastic supporting piece having a slanting face, and the slide member has a slanting face opposed to the slanting face of the holder; and wherein the button is connected to the elastic supporting piece so that when the button is pressed inward by the user, the slanting faces are brought into pressing contact and slide on one another to advance the slide member.

14. A mechanical pencil according to claim 1; wherein the holder has an elastic portion having a slanting face and the slide member has a slanting face opposed to the slanting face of the holder; and wherein the button is connected to the elastic portion so that when the button is pressed inward by the user, the elastic portion flexes downward causing the slanting face of the holder to press against and slide along the slanting face of the slide member to advance the slide member.

15. A mechanical pencil according to claim 14; wherein the slanting faces slant downward in a front-to-rear direction.

16. A mechanical pencil according to claim 14; wherein the cam mechanism includes a substantially parallelogram-shape guide window and a control projection movable along the edges of the guide window.

17. A mechanical pencil according to claim 16; wherein the guide window is formed in the holder and the control projection is provided on the sleeve and controls the movement of the sleeve.

18. A mechanical pencil according to claim 14; further comprising a return-preventing mechanism that prevents turning of the pipe in the opposite direction when the sleeve turns in the opposite direction.

19. A mechanical pencil according to claim 18; wherein the return-preventing mechanism comprises a return-preventing gear face provided on the holder, and a return-preventing pawl provided on the pipe and slidably engageable with the return-preventing gear face to permit turning of the pipe in the one direction and prevent turning movement of the pipe in the opposite direction.

20. A mechanical pencil according to claim 1; wherein the button is located along the barrel at a position where a user grips the pencil during writing.

* * * * *